United States Patent [19]

Wyatt

[11] 4,083,617

[45] Apr. 11, 1978

[54] ELECTRICAL CONNECTOR

[75] Inventor: Robert S. Wyatt, Park Ridge, Ill.

[73] Assignee: Brad Harrison Company, LaGrange, Ill.

[21] Appl. No.: 783,674

[22] Filed: Apr. 1, 1977

[51] Int. Cl.[2] ..... H01R 25/00

[52] U.S. Cl. ..... 339/47 R; 339/206 R

[58] Field of Search ..... 339/47–49, 339/206

[56] References Cited

U.S. PATENT DOCUMENTS

| | | | |
|---|---|---|---|
| 3,091,746 | 5/1963 | Winkler | 339/47 R |
| 3,218,599 | 11/1965 | Winkler | 339/47 R |
| 3,909,099 | 9/1975 | Winkler | 339/47 R |

*Primary Examiner*—Mark S. Bicks

*Attorney, Agent, or Firm*—Emrich, Root, O'Keeffe & Lee

[57] ABSTRACT

An electrical connector assembly adapted for longitudinal telescoping engagement includes first and second identical insulating connecting housing portions containing rigid contact terminal members. The insulated connecting housings surrounding and enclosing the terminal members are composed of a polycarbonate resin material and are adapted to receive and fixedly hold a U-shaped spring member which engages the end of the terminal member to bias and hold the same in rigid contacting position. The housing includes also a removable insulating wall member which is engageable with the terminal members when the terminal members have been fully inserted into the connecting housing to assist in retaining the terminal members in rigid contact position. The wall member is a thermoset high heat resistance glass filled nylon material which prevents disintegration of the connecting housings upon extended use of the electrical connector assembly.

8 Claims, 7 Drawing Figures

FIG. 1
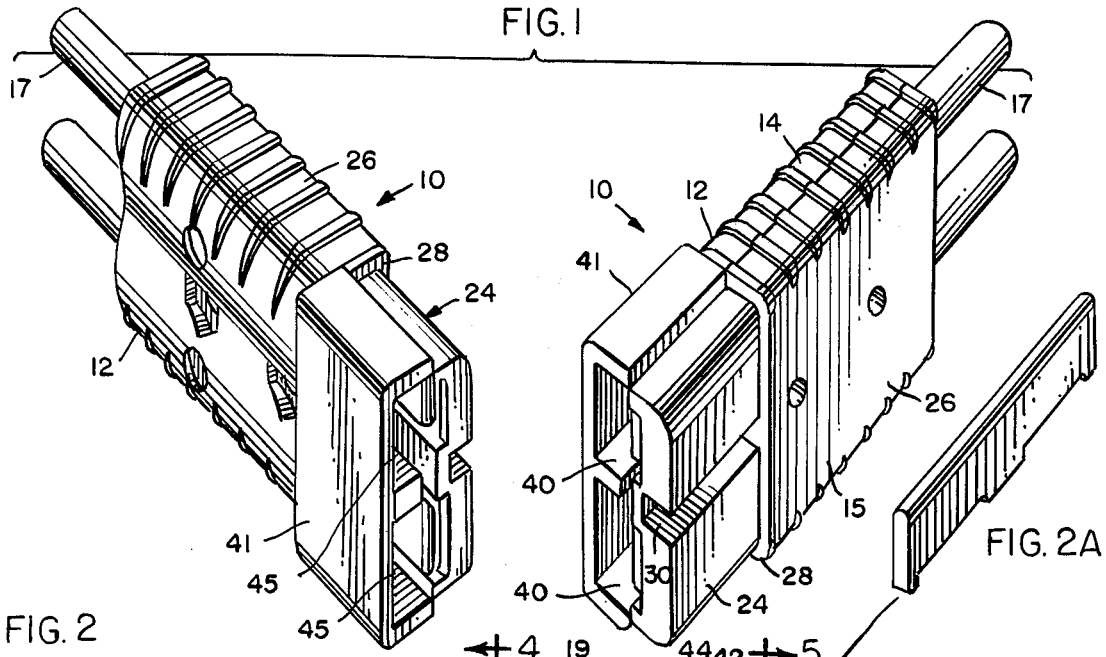
FIG. 2
FIG. 2A
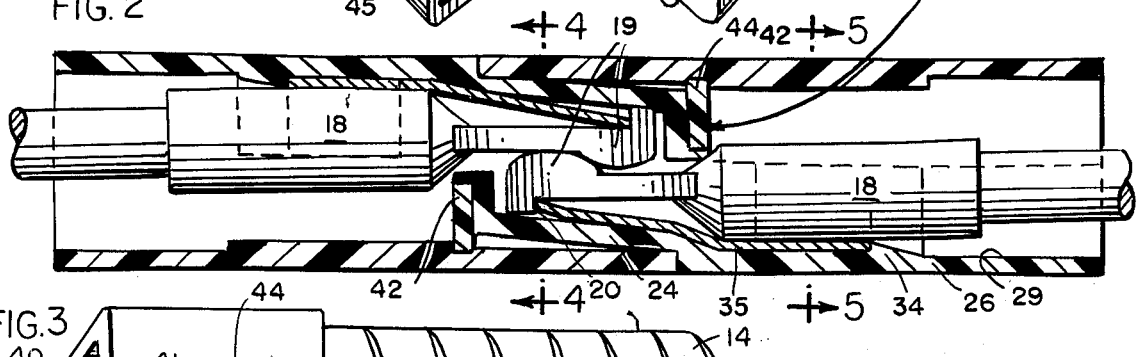
FIG. 3
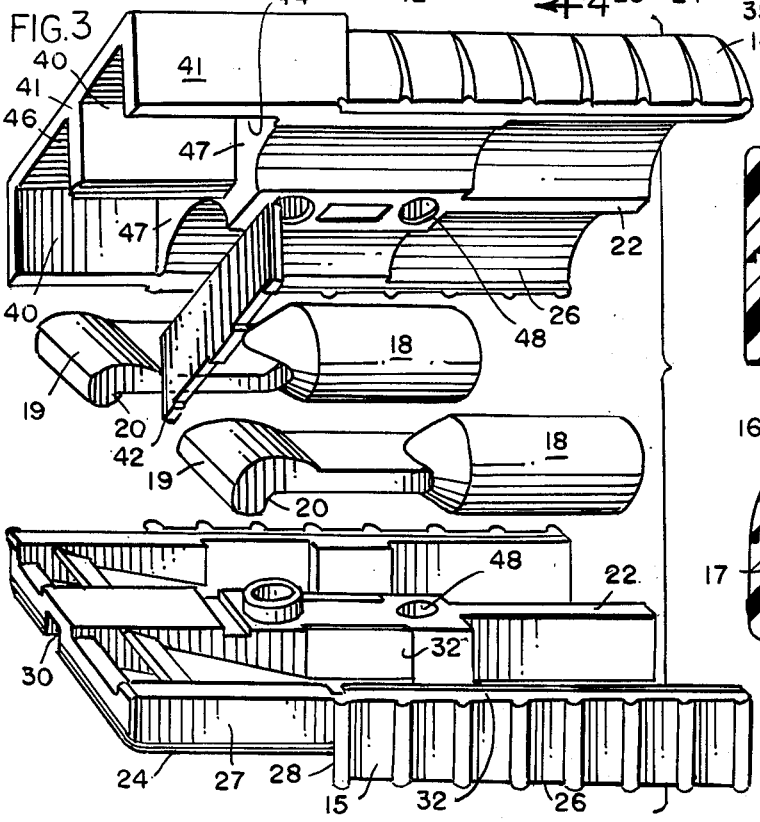
FIG. 4
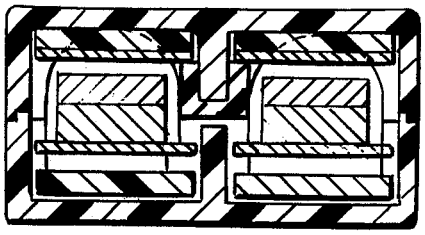
FIG. 5
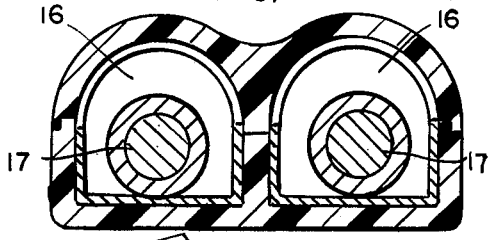
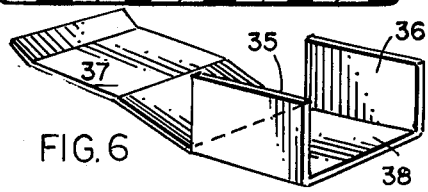
FIG. 6

ELECTRICAL CONNECTOR

BACKGROUND OF THE INVENTION

The present invention relates to an improved electrical connector assembly possessing high heat resistance and positive biasing means fixedly mounted therein and engageable with the ends of the inserted terminal member to bias the same in rigid contacting position.

In the past, it has been the practice to mold plastic insulating electrical connector assemblies comprised of first and second connecting housings which are adapted for longitudinal telescoping engagement together. Each of the connecting housings include terminal contact members mounted therein such that when the housings are matingly telescoped together, the terminal contact members are engaged and interlocked together to provide the electrical contact connection.

As described in U.S. Pat. No. 3,091,746, the insulative connector housings are of a substantially rectangular form split longitudinally to form two half sections. The lower section including an elongated leaf spring loosely positioned therein which engages the end of the terminal member to bias the same upwardly to provide the interlocked connection with another insulated connector housing containing an oppositely mounted terminal member, is well known in the art. The lower section includes a pocket portion and a body portion adapted to receive the terminal members with the side and bottom walls of the pocket portion being recessed or offset from the main body portion to provide shoulder portions and the spaced relationship of the pockets providing a slot extending to the plane of the shoulder portion to permit telescoping of the housings together. The upper half section of the insulated connector housing is provided with a corresponding forwardly extending portion coextensive with the body portion and shaped to provide two inverted U-shaped sockets which are opened at the outer ends and closed at the inner ends by an integrally mounted wall portion defining the end of the body portion. The sockets of the upper half section extend over the pockets of the lower half section and are of such a size and dimension as to snugly receive the pockets of the second connector housing when the same are telescoped together. The wall portion is integrally molded to and part of the insulated connector housing and is engageable with the inserted terminal member when the member is fully inserted into the housing. Additionally, it has been found that the most widely used commercial material for molding the insulated connector housing is a polycarbonate resin known as Lexan, a trademark of the General Electric Company. Because the wall portion is in direct contact with the terminal ends of the electrical connector during usage, the wall portion, or polycarbonate resin oftentimes heats up and melts thereby destroying the effectiveness of the electrical connector assembly. Thus, it has been found that where excessive loads are carried by the electrical connector over prolonged periods of time, the connector housings of the prior art do not provide sufficient heat resistance to be commercially acceptable.

Additionally, the prior art electrical connectors include a biasing spring either mounted on the terminal end of the terminal member or loosely positioned within the housing, with the spring biasing the terminal member to provide an interlocked connection. Because the leaf springs are either loosely attached on the terminal ends or loosely positioned in the housings, it has been found that rapid and repeated disengagement of the electrical connection results in the electrical spring members being pulled out of the electrical housing thereby destroying the utility of the electrical connector and severely restricting its applications.

SUMMARY OF THE INVENTION

One object of the present invention is to provide a long lasting electrical connector housing have an insertable heat resistive barrier member therein which is more heat resistive than the material comprising the connector housing.

It is another object of the present invention to provide an electrical connector housing adapted to fixedly receive a U-shaped leaf spring which biases and holds the terminal members in interlocked electrical connection.

It is still another object of the present invention to provide an improved electrical connector housing assembly.

In accordance with the present invention the electrical connector assembly is employed to connect together electrical terminal cables for various applications. The electrical connector housing assembly comprises a hollow insulated housing having rigid terminal cable members extending into the housing and mounted in detached relationship with respect to the walls of the housing and adapted for locking engagement with terminal members of a corresponding similar second hollow insulated connector housing. Each of the thermal resistant plastic housings include upper and lower half sections having a central partition wall extending along the length thereof which defines and separates a forward extending pocket portion and a rearwardly extending body portion which is adapted to receive the terminal members. In the lower half section, the side walls of the pocket portion are recessed or offset from the body portion to provide shoulder portions and the spaced relationship of the pockets thereby providing a slot extending to the plane of the shoulder portion to permit telescoping of the housings together. The body portion of the lower section includes also aligned recesses or grooves on the side walls of the body portion which are adapted to receive an elongated U-shaped leaf spring therein. When the elongated leaf spring is mounted within the grooves or recesses on the side walls of the body portion, the elongated U-shaped leaf spring is rigidly and fixedly held to extend into the pocket portion of the lower half section. The leaf spring is adapted to resiliently engage the rear face of the ends of the terminal members of the cable to prevent withdrawal of the terminal member from the insulated housing and to bias the end of the terminal member into an interlocked engaging connection when each of the connector housings are telescoped together. Also, to assist insertion of the terminal member into the housing, the bottom wall of the body portion includes an inclined ramp portion which abuts the end of the U-shaped leaf spring.

The upper half section of the insulated connector housing is provided with a corresponding forwardly extending body portion coextensive with the body portion of the lower half section and shaped to provide two inverted sockets which are opened at the outer ends and closed at their inner ends by the transversely mounted wall barrier member. The removable wall barrier portion is composed of a plastic material other than the material that is normally used in molding the electrical connector assembly. Preferably, the electrical connector assembly is comprised of molded polycarbonate resinous material known as Lexan, a trademark of the General Electric Company. Importantly, it has been found that when the wall barrier member portion is composed of a glass filled nylon material the wall barrier member, which is in contact with the inserted terminal ends of the terminal member, provides greater resistance to heat thereby extending the life of the electrical connector assembly. Thus, it has been found that where the electrical connector carries excessive loads over prolonged periods of time, the high heat resistance of the wall barrier member extends the life of the electrical connector assembly.

Additionally, it has been found that by fixedly mounting the resilient elongated leaf spring within the insulated housing, upon extended and repeated disconnection of the electrical connector assembly the leaf spring remains intact within the insulated housing to provide a longer lasting electrical connector assembly than has heretofore been possible.

DESCRIPTION OF THE DRAWINGS

FIG. 1 is a perspective view of a pair of identical two-pole connector housings which are matingly engageable together in accordance with the present invention;

FIG. 2 is a cross-sectional view of the electrical connector assembly in assembled relationship in accordance with the present invention;

FIG. 3 is an exploded perspective view of a two pole electrical connector showing the relationship of the parts thereof in accordance with the present invention;

FIG. 4 is a cross-sectional view taken along the lines 4—4 of FIG. 2;

FIG. 5 is a cross-sectional view taken along the lines 5—5 of FIG. 2; and

FIG. 6 is a perspective view of the elongated U-shaped leaf spring in accordance with the present invention.

DETAILED DESCRIPTION

Referring now to the drawings wherein like numerals have been used throughout the several views to designate the same or similar parts, in FIGS. 1 – 5 the electrical connector assembly 10 of the present invention is shown as including a connector housing 12 having an upper half section portion 14 and a base or lower half section portion 15. The connector housing 12 is formed to provide a hollow cavity 16 (FIG. 5) therein for enclosing any number of terminal cable members 17 (FIGS. 2 and 3) each having a forward extending conductor portion 18 integral therewith. Each of the forward extending conductor portions 18 includes a rounded end portion 19 having a lip portion 20 thereon. The conductor portion 18 is adapted to be engageable with a corresponding conductor portion on another terminal cable member 17 to complete the electrical contact therebetween, as will hereinafter be described.

The base or lower half section 15 (FIG. 3) of the connector housing 12 includes a central partition wall 22 extending along the length thereof which defines and separates a forward extending pocket portion 24 and a rearwardly extending body portion 26 which is adapted to receive the terminal cable members 17. In the lower half section 15, the side walls 27 of the pocket portion 24 are recessed or offset from the body portion 26 to provide shoulder portions 28 and the spaced relationship of the pocket portion 24 thereby providing a slot 30 extending to the plane of the shoulder portion 28 to permit telescoping of the connector housings 12 together.

The rearwardly extending body portion 26 of the lower or base half section 15 includes also aligned recesses or grooves 32 (FIG. 3) on the side wall 27 and partition wall 22 thereof which are adapted to receive an elongated U-shaped leaf spring 35 therein. The leaf spring 35 (FIG. 6) includes a pair of U-shaped extensions 36 extending upwardly therefrom which are adapted to be received by the aligned recesses or grooves 32 in the side wall 27 and partition wall 22 of the body portion 26 of the lower half section 15. Accordingly, when the elongated leaf spring 35 is mounted within the grooves or recesses 32 of the side wall 27 and partition wall 22 of the body portion, the leaf spring is rigidly and fixedly held within the body portion with the tongue portion 37 thereof extending into the pocket portion 24 of the lower half section 15. For convenience and to assist insertion of the terminal cable members 17 into the connector housing 12, the bottom wall 29 of the body portion 26 includes an inclined ramp portion 34 (FIG. 2) which abuts the end 38 of the leaf spring 35.

The upper half section 14 (FIG. 3) of the connector housing 12 is also provided with a central partition wall 22 extending along the length thereof and coextensive with the body portion of the lower half section 15. The wall 22 defines a rearwardly extending body portion 26, coextensive with the body portion 26 of the lower half section 15, and a forward extension 41 shaped to provide two inverted sockets 45 having openings 40 therein which are opened at the outer end 46 and closed at their inner ends 47 by a transversely mounted wall barrier member 42 (FIG. 2A), which is adapted to be received by transverse slotted opening 44 in the upper half section 14.

Preferably, the electrical connector assembly housing 12 is comprised of a molded polycarbonate resinous material, commercially available as Lexan, a trademark of the General Electric Company, and the wall barrier member 42 is composed of a glass filled nylon material. Thus, the removable wall barrier portion 42 is composed of a material other than the plastic material that is commonly used in molding the electrical connector housing 12. Importantly, the glass filled nylon material possesses superior electrical properties which may be maintained under high temperature and humidity conditions and high temperature resistance.

As shown in FIG. 3, the connector housing 12 is assembled by fixedly positioning the leaf spring 35 in the aligned recesses and grooves 32 in the side wall 27 and partition wall 22 of the body portion 26 of the lower half section 15. The wall barrier member 42 is then inserted into the transverse slotted opening 44 and the upper half section 14 is lowered onto and aligned with the lower half section 15. At this point the two half sections may be either permanently sealed together by any suitable process, such as ultrasonic welding, or may be secured together by fastening means (not shown) positioned through openings 48 in the lower and upper half sections. After the connector housing 12 has been assembled together, the terminal cable members 17 are inserted into the body portion cavity and the rounded end portion 19 moved past the inclined ramp 34 onto the tongue portion 37 until tongue portion of the leaf spring 35 engages the lip portion 20 to retain the terminal cable member firmly against the wall barrier member 42, a position as partially shown in FIG. 2. When identical connector housings 12, having the inserted cable members therein, are then telescoped together, the rounded end portions 19 of the terminal cable members 17 engage one another and provide a camming action therebetween to firmly interlock the connector housing 12 together, a position as shown in FIG. 2. Thus, the leaf spring 35 is adapted to resiliently engage the lip portion 20 of the rear face of the end of the terminal members 17 to prevent withdrawal of the terminal member 17 from the insulated housing and to bias the terminal member into an interlock and engaging connection with other terminal members mounted in another connector housing when the connector housings are telescoped together.

Because the wall barrier member 42 is in contact with the conductor portion 18 of the terminal cable member 17, the wall barrier member must be highly resistive to heat and deformation. Accordingly, it has been found that by utilizing a removable or wall barrier member comprised of a glass filled nylon material, that the life of the electrical connector assembly is greatly lengthened. This is particularly true where the electrical connector assembly must carry excessive loads over prolonged periods of time. Additionally, by fixedly mounting the leaf spring 35 within the connector housing 12, repeated disconnection and connection of the electrical connector assembly does not disturb or effect the efficiency of the leaf spring thereby resulting in greater wear of the connector assembly than has heretofore been possible by prior art devices.

Although the present specification discloses a two-pole electrical connector assembly, the disclosure has applicability to single-pole as well as assemblies containing a plurality of terminals therein. What has been described therefore is a unique electrical connector assembly having high heat resistance and capable of providing repeated connection and disconnection without wear of the connector assembly.

I claim:

1. An electric connector comprising:

a housing of electrically insulated material, said housing including a top portion and a base portion, said top portion being generally rectangular in shape and providing a forward socket portion and further having a transverse slotted opening across the width thereof, said base portion being substantially rectangular in form as said top portion and having a pocket portion and a rearward extending body portion with said body portion having aligned grooves on the side thereof, spring means mounted in said aligned grooves of said body portion and having a tongue portion extending into said pocket portion of said base portion, a barrier member insertable into said slotted opening in said top portion, and terminal means positioned in said body portion of said housing and engageable with said leaf spring and said barrier member to be firmly retained within said pocket portion of said base portion when said top portion is attached to said base portion.

2. The electrical connector in accordance with claim 1 wherein said barrier member is composed of a glass filled nylon material.

3. The electrical connector in accordance with claim 1 wherein said spring means includes a U-shaped leaf spring having projections extending upwardly therefrom which are adapted to be received by said aligned grooves to fixedly hold said leaf spring in said housing.

4. The electrical connector in accordance with claim 1 wherein said housing is composed of a polycarbonate resinous material.

5. An electrical connector having a housing comprised of an upper and lower half section defining an opening therein adapted to receive at least one terminal member therein, the housing being further capable of being telescoped together with another identical housing to provide an electrical connection, the improvement including in combination:

spring means fixedly mounted within the housing and engageable with the terminal member on the insertion thereof into the housing to hold the same within the housing, and a removable heat resistant barrier member insertable into the housing and engageable with the terminal member and having a higher softening point than said housing to prevent deformation of the electrical connection upon protracted use and heavy loads.

6. The electrical connector in accordance with claim 5 wherein said removable heat resistant barrier member is composed of a glass filled nylon material.

7. The electrical connector in accordance with claim 5 wherein said spring means is a U-shaped leaf spring having a pair of extensions extending upwardly therefrom and a tongue portion extending forwardly therefrom which is engageable with the inserted terminal member to retain and hold the same within the housing.

8. An electrical connector assembly including in combination:

a pair of insulating housings each having upper and lower half sections containing a cavity therein and defining a forwardly extending pocket portion and a rearwardly extending body portion, leaf spring means fixedly mounted within said body portion of each of said housings, terminal means extending into each of said housings and engageable with said leaf spring means to hold the same within the housing, said terminal means within one housing being adapted for engagement with said terminal means mounted in the other of said housings, and removable heat resistant barrier plate means positioned within each of said housings and engageable with said terminal means therein to firmly hold the same within said housing, such that upon the telescopic engagement of each of said housings with respect to one another, said terminal means are in aligned opposed relationship and firmly interlocked together to complete the electrical connection, each of said heat resistant barrier plate means having a higher softening point than said housing in which it is located.

* * * * *